United States Patent [19]

Beck

[11] 4,055,738

[45] Oct. 25, 1977

[54] MULTIPLE SWITCH MOUNT

[75] Inventor: Herbert C. Beck, San Jose, Calif.

[73] Assignee: Electronic Engineering Co. of California, Santa Ana, Calif.

[21] Appl. No.: 668,543

[22] Filed: Mar. 19, 1976

[51] Int. Cl.[2] ..... H01H 9/00

[52] U.S. Cl. ..... 200/296; 248/27.1

[58] Field of Search ..... 200/296, 295, 307; 248/27.1, 27.3; 220/3.6, 3.5; 339/128, 126 R, 126 RS

[56] References Cited

U.S. PATENT DOCUMENTS

| | | | |
|---|---|---|---|
| 2,869,098 | 1/1959 | Sauer | 339/128 X |
| 3,091,679 | 5/1963 | Norden | 339/128 X |
| 3,159,365 | 12/1964 | Watson | 248/27.1 |
| 3,191,135 | 6/1965 | Hazelquist | 248/27.3 X |
| 3,337,836 | 8/1967 | Churla | 339/128 X |

*Primary Examiner*—J. V. Truhe
*Assistant Examiner*—D. A. Tone
*Attorney, Agent, or Firm*—Harry R. Lubcke

[57] ABSTRACT

A mount for attaching a device such as a multiple switch within a hole in a panel. A first part has a lip for laying upon the front of the panel and also a pair of spaced hook arms. A second part is attached to the device behind the panel and has an opening for receiving the hook arms. These resiliently enter the opening in the second part and hold the device securely but removably to the panel. Screws or tools are not required. Deformable ears on the second part bear against the back of the panel to secure the assembly, and the ear structure accommodates a range of panel thicknesses.

11 Claims, 6 Drawing Figures

MULTIPLE SWITCH MOUNT

BACKGROUND OF THE INVENTION

This invention pertains to detatchable self-locking mountings.

The prior art has provided single-piece mountings having resilient legs with fish-hook ends that lock an assembly to the metal-work of domestic appliances.

Bushings and lamp sockets have been fastened to panels by means of resilient locking fingers only.

Insulating cam means have also been used for fastening a rotary potentiometer to a panel in a non-wobble manner.

SUMMARY OF THE INVENTION

The mount provides means for attaching a device such as a multiple thumbwheel switch securely but removably to a panel through a single-cut without the use of tools.

A first part of the mount has a lip to lie upon the front of the panel and a pair of spaced hook arms to extend behing the panel. A second part is attached to the device behind the panel and has an opening for receiving the hook arms. Deformable ears on the second part bear against the back of the panel to secure the assembly. These accommodate a range of panel thicknesses.

DESCRIPTION OF THE PREFERRED EMBODIMENTS

Figure 1:
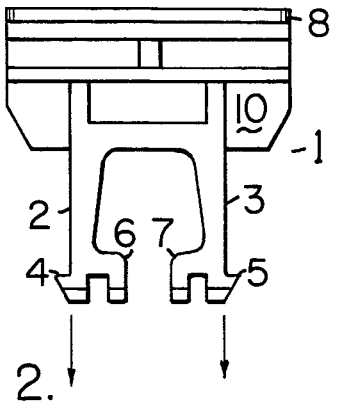
FIG. 1 is a side elevation of the first part of the mount.

In FIG. 1 numeral 1 indicates in general the first piece of the mount according to the invention. It is typically moulded in one piece of a polycarbonate or the synthetic polymeric amide known as Nylon. These materials have nominal flexibility so that the spaced hook arms 2 and 3 will bend inward by the amount of the fish-hook portions 4 and 5 when the first piece of the mount is combined with the second piece.

The extremities of the hook arms also have spurs 6 and 7 on the inward sides. These form a niche or slot in combination with each fish-hook portion for the purpose of allowing insertion of a pointed tool or similar device to urge a hook arm inward. This is for the purpose of opening the catch provided by the fish-hook portion to allow disassembly of the mount. The pointed tool may be a small screw driver, the point of a mechanical pencil, or the tips of needle-nosed pliers. Disassembly can be accomplished by moving one hook arm at a time, or with the pliers both arms can be moved at one time.

Figure 3:
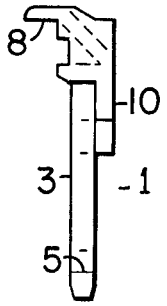
FIG. 3 is an end elevation of the first part of the mount.

Lip 8 lies upon the front panel and provides one-half of the basic securing structure that firmly fastens the switch-mount to a front panel 9. See FIGS. 3 and 5.

Body 10 of the first piece extends as a plate to lie against certain portions of the second part of the mount and serves as a body to bind together the hook arms and the lip.

The lower extremities of the hook arms are chamfered so that insertion into the second part of the mount will be easy.

Figure 2:
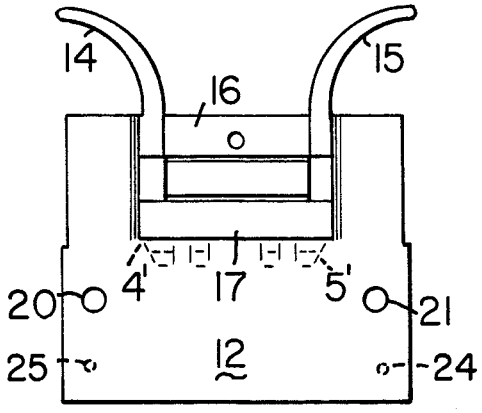
FIG. 2 is a side elevation of the second part of the mount, being in alignment with the first part.
Figure 4:
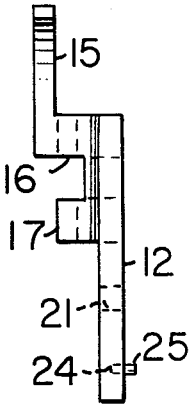
FIG. 4 is an end elevation of the second part of the mount, also in alignment.

Second part 12, FIGS. 2 and 4, is typically fabricated by moulding of the same material as the first part, since ears 14 and 15 must have some flexibility; preferably enough to accommodate panel thicknesses from 1 through 4 mm.

In addition to the ears, two strap-like projections 16 and 17 are provided one above the other at the upper central portion of plate-like second part 12 of the mount. The internal rectangular opening of each of these strap-like projections has a lateral extent equal to the outer relaxed spread of hook arms 2 and 3. When the two arms have been fully inserted the fish-hook portion catches upon the under side of strap projection 17. This relation is shown in partial phantom at 4' and 5' in FIG. 2 to aid comprehension.

While the mount according to this invention may be made in any size, the drawing shows it approximately twice full size.

Accordingly, ears 14 and 15 may have a cross-section of 2 by 1.5 mm. When panel 9 is only 1 mm thick the ears will be only slightly pressed apart. With a panel thickness of 4 mm the ears will be markedly pressed apart. It is this variation that provides a snug fit of the mount and switch assembly to the panel regardless of its thickness, within limits.

Figure 5:
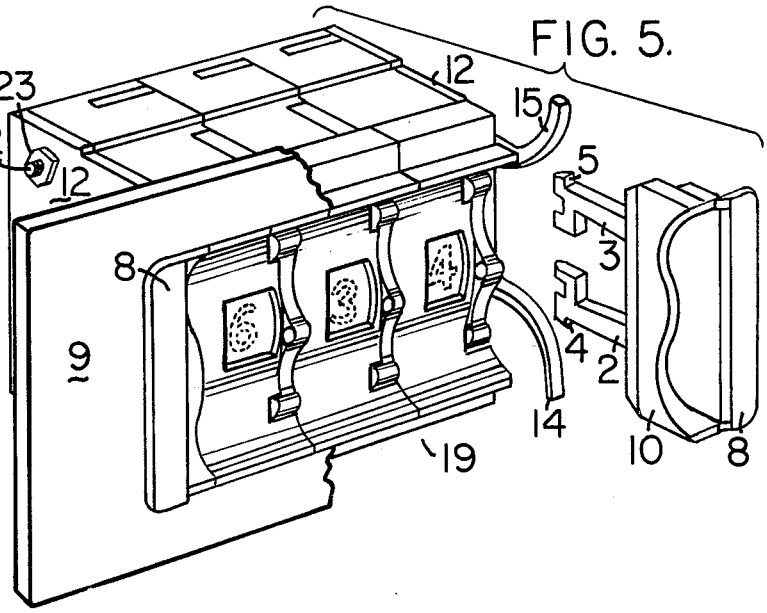
FIG. 5 is a perspective view of the second part of the mount attached to a multiple thumbwheel switch, with the first part of the mount aligned for insertion.

It will be seen in FIG. 5 and it may be inferred from the nature of the mount of this invention, that only a single rectangular punch-out is required in the panel in order to mount multiple switch 19, or the equivalent, upon the panel. Additional holes to pass mounting screws, or even extensions of the rectangular hole, are not required.

Two holes 20 and 21 are preferably provided, spaced apart in the lower area of second part 12, near the sides thereof. These holes match a relatively standard spacing of 2.4 cm and a diameter of 2.5 mm that pass through each unit of a multiple switch, as 19 in FIG. 5. Threaded studs 22, each of a length sufficient to pass through the number of switch units desired in the assembly, are employed in this instance to also pass through holes 20 and 21 in the two second parts that are used to provide the mounting. A nut 23 is tightened at each extremity of the studs to bind the whole assembly together.

To assist in alignment, each switch unit and second part 12 have blind hole 24 and boss 25 near opposite lower corners. The boss of one element enters the blind hole of the next. A diameter of 1 mm is typical for these elements.

In installing the assembly, the switch 19 with second parts 12 secured to each end thereof is held behind the rectangular cut-out in panel 9 with one's hand or some mechanical equivalent. At each end of the cut-out and from the front of the panel a first part 1 of the mount of this invention is pressed through the cut-out inboard of the location of ears 14 and 15. This allows hook arms 2 and 3 to enter the passage way formed by strap projection 17, etc. When first part 1 has been pressed fully home the fish-hook portions 4 and 5 snap out and the whole assembly is immovably secured.

Lips 8 provide a finished appearance on the front panel. There are no mounting screw heads to detract from the appearance or make cleaning difficult, as in the prior art. Also, the simple rectangular cut-out and the simple mode of assembly of the whole structure with the use of the mount of this invention saves appreciable cost in manufacturing apparatus that uses the mount.

Any number of switch units, or equivalent, may be mounted, as from one to perhaps twenty.

The whole assembly can be dismounted from the panel by inserting a pointed tool in each of the niches adjacent to spurs 6 and 7 and forcing the hook arms together sufficiently to allow the fish-hook portions 4 and 5 to clear strap 17 and then urging first part 1 forward out of the panel. This function can be most conveniently performed by the free ends of needle nosed pliers, one free end in each niche.

Since nothing is damaged in the removal the whole assembly can be remounted. This allows a switch unit or units to be replaced.

An alternate element is available for fastening the two second parts of the switch mount and the one or more switch units.

This takes the form of an ultimately rectangularly shaped wire 27 which is shown aligned with, but not within the assembly of FIG. 5. This wire is shown is FIG. 6. It is preformed with inwardly shaped ends 28 and 29 and parallel sides 30 and 31. The free end 29 is bent backwards on both sides, so as to be colinear with sides 30 and 31, and it is pushed through the aligned holes in the whole assembly that are typified by holes 20 and 21, that are shown in the second part 12 in FIG. 2.

Figure 6:
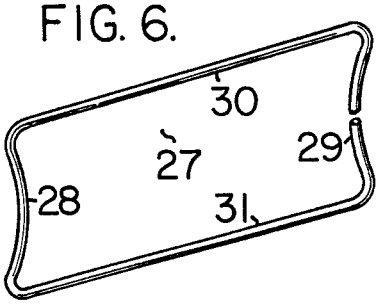
FIG. 6 is a perspective view of a wire alternate structure for fastening the assembly together, being aligned with the switch structure of FIG. 5.

After this, a major force is exerted on end 28, to linearize it from the curved inward shape shown in FIG. 6 to have it lie in essentially a straight line against the adjacent second part 12. While thus configured the two ends of 29 are bent firmly against the opposite second part 12 at the other side of the assembly. When all forces are removed the wire holds the whole assembly firmly together.

The wire may be quarter-hard to half-hard aluminum, such as #5356, which has spring characteristics. Alternately, stainless steel may be used, of a springy type, such as #302.

Wire 27 is preferably a free fit in holes 20 and 21, such as having diameter of 1.5 mm for 2.2 mm diameter holes.

An assembly forming tool may be used. As previously set forth it provides a preload stress by linearlizing end 28 and also the same by bending ends 29 slightly more than 90° so that the free ends press inwardly on opposite second part 12. This manipulation can be accomplished by hand with chain-nosed or round-nosed pliers.

The preformed wire fastener 27 can be disassembled by using pliers or an equivalent tool for straightening ends 29 to colinearity with sides 30 and 31. The fastener can subsequently be used again by following the steps also given above.

I claim

1. The combination with a device having ends and a panel having a hole with a mount for attaching said device in the hole of said panel, comprising;

a. one first part (1) of said mount lodged at each end of said device within the hole in said panel, between the device and the panel, b. said first part having a lip (8) lying upon the front of said panel and two spaced hook arms (2, 3) extending through said hole and behind said panel, c. one second part (12) of the mount mounted upon each of the same said ends of the device behind said panel, d. each said second part having an opening which receives both of said hook arms of a one said first part, and e. each said second part having deformable ears (14, 15) bearing upon the rear of said panel, whereby said device is removably locked to said panel by said first and second parts.

2. The combination of claim 1, in which;

a. said hook arms are formed of a semi-flexible material, and b. each extremity of said arms rearward of said panel has a fish-hook configuration which resiliently locks into the opening of said second part.

3. The combination of claim 1, in which;

a. said opening is formed of two aligned rectangular strap-like projections (16, 17) extending away from the surface of said second part.

4. The combination of claim 3, in which;

a. said deformable ears surmount the upper of the two aligned projections.

5. The combination of claim 3, in which;

a. said deformable ears extend mutually away from each other at the extremities thereof away from said upper projection.

6. The combination of claim 2, in which;

a. the fish-hook portions of each of the two hook arms extend mutually away from each other.

7. The combination of claim 2, which additionally includes;

a. a spur (6, 7) disposed inwardly to form a niche at the extremity of each of the two hook arms.

8. The combination of claim 1, in which;

a. the first and second parts are fabricated of a polycarbonate.

9. The combination of claim 1, in which;

a. the first and second parts are fabricated of a synthetic polymeric amide.

10. The combination of claim 1, which additionally includes;

a. a wire (27) passing through said second parts and through said device plural times to retain said second parts in contact with said device.

11. The combination of claim 10, in which;

a. said wire is a single piece of wire having an essentially over-all rectangular shape as installed under stress into said device and passing through said second parts.

* * * * *